US009857111B2

(12) United States Patent
McMasters et al.

(10) Patent No.: US 9,857,111 B2
(45) Date of Patent: Jan. 2, 2018

(54) METHOD AND APPARATUS FOR RECOVERING REFRIGERANT FROM AN AIR CONDITIONING SYSTEM

(71) Applicants: Bosch Automotive Service Solutions LLC, Warren, MI (US); Robert Bosch GmbH, Stuttgart (DE)

(72) Inventors: Mark W. McMasters, Owatonna, MN (US); Dylan M. Lundberg, Lonsdale, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 652 days.

(21) Appl. No.: 14/541,219

(22) Filed: Nov. 14, 2014

(65) Prior Publication Data

US 2015/0153083 A1 Jun. 4, 2015

Related U.S. Application Data

(60) Provisional application No. 61/911,654, filed on Dec. 4, 2013.

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01); *F25B 2345/003* (2013.01); *F25B 2345/006* (2013.01); *F25B 2345/0052* (2013.01)

(58) Field of Classification Search
CPC ..... F25B 45/00; F25B 43/006; B60H 1/00585
See application file for complete search history.

(56) References Cited

U.S. PATENT DOCUMENTS 5,024,061 A * 6/1991 Pfeil, Jr. ..... F25B 45/00 62/292
5,182,918 A 2/1993 Manz et al.
5,325,675 A * 7/1994 Manz ..... F25B 45/00 62/149

(Continued)

OTHER PUBLICATIONS

European Search Report and Written Opinion for Corresponding European Patent Application No. 14195273.9, dated Jul. 30, 2015 (7 pages).

*Primary Examiner* — Dominick L Plakkoottam
*Assistant Examiner* — Antonio R Febles
(74) *Attorney, Agent, or Firm* — Maginot, Moore & Beck LLP

(57) ABSTRACT

A refrigerant service system according to the disclosure includes an inlet port configured to connect to an air conditioning system, a recovery valve fluidly connected to the inlet port, an accumulator fluidly connected to the recovery solenoid valve and including a pressure transducer configured to generate an electronic signal corresponding to a pressure in the accumulator, and a controller. The controller is configured to determine a target pressure for the accumulator based upon a condition of the refrigerant, obtain a current pressure in the accumulator from the pressure transducer, and to operate the recovery valve based upon the accumulator target pressure to control flow of refrigerant from the air conditioning system to the accumulator based upon the obtained current pressure and the determined target pressure for the accumulator.

14 Claims, 9 Drawing Sheets

(56) References Cited

U.S. PATENT DOCUMENTS

| | | | | |
|---|---|---|---|---|
| 6,138,462 | A * | 10/2000 | Murray | B60H 1/00585 62/149 |
| 6,442,963 | B1 * | 9/2002 | Pfefferle | B60H 1/00585 62/144 |
| 2006/0130510 | A1 * | 6/2006 | Murray | B60H 1/00585 62/292 |
| 2009/0133435 | A1 * | 5/2009 | Toyoshima | F25B 31/004 62/473 |
| 2012/0291457 | A1 * | 11/2012 | Brown | F25B 45/00 62/77 |
| 2013/0008192 | A1 | 1/2013 | McMasters et al. | |
| 2013/0047635 | A1 * | 2/2013 | Shultz | F25B 45/00 62/77 |
| 2013/0047636 | A1 * | 2/2013 | Cording | F25B 45/00 62/77 |
| 2013/0047637 | A1 * | 2/2013 | Cording | F25B 45/00 62/77 |
| 2013/0298578 | A1 * | 11/2013 | McMasters | F25B 45/00 62/77 |
| 2014/0182312 | A1 | 7/2014 | Lundberg et al. | |

* cited by examiner

METHOD AND APPARATUS FOR RECOVERING REFRIGERANT FROM AN AIR CONDITIONING SYSTEM

CLAIM OF PRIORITY

This application claims the benefit of priority to U.S. provisional application No. 61/911,654, filed on Dec. 4, 2013, the disclosure of which is incorporated herein by reference in its entirety.

TECHNICAL FIELD

This disclosure relates generally to refrigeration systems, and more particularly to refrigerant recovery systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein is periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include hoses coupled to the refrigeration circuit to be serviced. A vacuum pump and compressor operate to recover refrigerant from the vehicle's air conditioning unit, flush the refrigerant, and subsequently recharge the system from a supply of either recovered refrigerant and/or new refrigerant from a refrigerant tank.

Refrigerant vapor entering the ACS unit is first passed through a filter and dryer unit to remove contaminants and moisture from the recovered charge and then through an accumulator to remove oil entrained in the refrigerant from the air conditioning system. The refrigerant is then pressurized by a compressor before it is stored in a storage tank.

In typical ACS units, the pressure of the refrigerant flowing into the accumulator is regulated by an expansion valve upstream of the accumulator. The expansion reduces the pressure of the incoming refrigerant, which serves to change the state of the refrigerant from a liquid to a gas. Since the oil boils at a lower pressure than the refrigerant at a given temperature, the oil remains in a liquid state and is separated from the vaporized refrigerant. The refrigerant exiting the accumulator must be in the vapor state to prevent liquid refrigerant from entering the compressor, which can cause damage to the compressor. The expansion valve typically sets the pressure in the accumulator as a constant value, which is near the saturated vapor pressure of the refrigerant at the coldest ambient temperature at which the unit is allowed to be operated. For example, in a typical ACS unit, the accumulator is pressurized to 35 psi, which is slightly below the saturated vapor pressure of R134a at 50° F.

Operating the accumulator in an ACS unit at a higher pressure reduces recovery time, increases recovery efficiency, and improves oil separation performance. What is needed, therefore, is an ACS unit which operates at varying operating accumulator pressures in order to optimize recovery performance.

SUMMARY

In a first embodiment, a refrigerant service system according to the disclosure comprises an inlet port configured to connect to an air conditioning system, a recovery valve fluidly connected to the inlet port, an accumulator fluidly connected to the recovery solenoid valve and including a pressure transducer configured to generate an electronic signal corresponding to a pressure in the accumulator, and a controller. The controller is operable to determine a target pressure for the accumulator based upon at least one sensed condition of the refrigerant, obtain a current pressure in the accumulator from the pressure transducer, and to operate the recovery valve based upon the accumulator target pressure to control flow of refrigerant from the air conditioning system to the accumulator based upon the obtained current pressure and the determined target pressure for the accumulator. Since the controller operates the valve based upon the determined target pressure in the accumulator, the accumulator is operated at a greater pressure than prior art systems. As a result, the refrigerant in the air conditioning system can be recovered in less time that previous recovery systems.

In another embodiment, the controller is further configured to operate the recovery valve to open in response to the obtained current pressure in the accumulator being less than the determined accumulator target pressure, and to operate the recovery valve to close in response to the obtained current pressure being greater than the determined accumulator target pressure. The controller therefore advantageously retains the pressure in the accumulator close to the target pressure by operation of the valve.

In yet another embodiment, the refrigerant service system further comprises temperature sensor located in the accumulator and configured to generate a temperature signal corresponding to a temperature of the refrigerant in the accumulator. The controller is further configured to obtain the temperature signal from the temperature sensor and to determine the target pressure in the accumulator based upon the temperature of the refrigerant in the accumulator. Determining the target pressure based on an actual temperature in the accumulator enables an accurate determination of the vapor pressure in the accumulator and an accurate setting of the target pressure.

In a further embodiment, the refrigerant service system includes an ambient temperature sensor configured to generate an ambient temperature signal corresponding to an ambient temperature. The controller is configured to obtain the ambient temperature signal and determine the target pressure in the accumulator based upon the ambient temperature signal.

In some embodiments, the controller is further configured to obtain at least two pressure readings from the pressure transducer in the accumulator, determine a rate of change of the accumulator pressure based upon the at least two pressure readings, and determine the target pressure in the accumulator based upon the determined rate of change of the accumulator pressure. The controller advantageously determines the target pressure without requiring any additional sensors.

In another embodiment, the refrigerant recovery system includes a refrigerant storage vessel fluidly connected downstream of the accumulator such that the recovered refrigerant can be stored in the refrigerant storage vessel.

In a further embodiment, a scale is configured to generate a mass signal corresponding to a sensed mass of the refrigerant storage vessel. The controller is further configured to obtain at least two sensed mass readings from the scale, determine a mass flow rate of refrigerant flowing into the refrigerant storage vessel as a function of the at least two sensed mass readings, and determine the target pressure in the accumulator based upon the determined mass flow rate of refrigerant flowing into the refrigerant storage vessel. The controller is able to determine quickly and accurately whether the accumulator pressure exceeds the target pressure based upon the rate of change of the refrigerant storage vessel mass. Furthermore, some prior art refrigerant service systems include a scale configured to measure the weight of the refrigerant storage vessel for other purposes, such that no additional equipment would be needed for the controller to determine the target pressure in this embodiment.

In another embodiment, the refrigerant service system includes a temperature sensor located at the refrigerant storage vessel and configured to generate a temperature corresponding to a sensed temperature of the refrigerant in the refrigerant storage vessel. The controller is configured to obtain at least two temperature readings from the temperature sensor, determine a rate of temperature change of the refrigerant in the refrigerant storage vessel based upon the at least two temperature readings, and determine the target pressure in the accumulator based upon the determined rate of temperature change of the refrigerant in the refrigerant storage vessel. The controller is able to determine quickly and accurately whether the accumulator pressure exceeds the target pressure based upon the rate of change of the refrigerant storage vessel temperature.

In a second embodiment according to the disclosure, a method of recovering refrigerant from an air conditioning system comprises determining an accumulator target pressure for an accumulator based upon a sensed condition of refrigerant, obtaining a current pressure in the accumulator from a pressure transducer configured to sense a pressure in the accumulator, and operating a recovery valve positioned in a fluid line between the accumulator and the air conditioning system and configured to control flow of refrigerant from the air conditioning system to the accumulator based upon the obtained current pressure signal and the determined target pressure for the accumulator. Since the recovery valve based upon the determined target pressure in the accumulator, the accumulator is operated at a greater pressure than prior art systems. As a result, the refrigerant in the air conditioning system can be recovered in less time that previous recovery systems.

In another embodiment according to the disclosure, the operating of the recovery valve further comprising opening the recovery valve in response to the obtained current pressure in the accumulator being less than the determined accumulator target pressure, and closing the recovery valve in response to the obtained current pressure being greater than the determined accumulator target pressure. The pressure in the accumulator is therefore advantageously retained close to the target pressure by operation of the valve.

In a further embodiment, the method includes obtaining a temperature in the accumulator from a temperature sensor located in the accumulator, and determining the target pressure in the accumulator based upon the obtained temperature in the accumulator. Determining the target pressure based on an actual temperature in the accumulator enables an accurate determination of the vapor pressure in the accumulator and an accurate setting of the target pressure.

In another embodiment according to the disclosure, the method further comprises obtaining at least two pressure readings from the pressure transducer in the accumulator, determining a rate of change of the accumulator pressure based upon the at least two pressure readings, and determining the target pressure in the accumulator based upon the determined rate of change of the accumulator pressure. The target pressure is advantageously determined without requiring any additional sensors.

In some embodiments, the method includes obtaining at least two sensed mass readings of a refrigerant storage vessel fluidly connected downstream of the accumulator from a scale configured to sense a mass of the refrigerant storage vessel, determining a mass flow rate of refrigerant flowing into the refrigerant storage vessel as a function of the at least two sensed mass readings, and determining the target pressure in the accumulator based upon the determined mass flow rate of the refrigerant flowing into the refrigerant storage vessel. The determination whether the accumulator pressure exceeds the target pressure can be performed quickly and accurately based upon the rate of change of the refrigerant storage vessel mass. Furthermore, some prior art refrigerant service systems include a scale configured to measure the weight of the refrigerant storage vessel for other purposes, such that no additional equipment would be needed for the determination of the target pressure.

In a further embodiment according to the disclosure, the method includes obtaining at least two temperature readings corresponding to a temperature of refrigerant in a refrigerant storage vessel fluidly connected downstream of the accumulator from a temperature sensor located at the refrigerant storage vessel, determining a rate of temperature change of the refrigerant in the refrigerant storage vessel based upon the at least two temperature readings, and determining the target pressure in the accumulator based upon the determined rate of temperature change of the refrigerant in the refrigerant storage vessel. The method enables quick and accurate determination of whether the accumulator pressure exceeds the target pressure based upon the rate of change of the refrigerant storage vessel temperature.

In a third embodiment according to the disclosure, a refrigerant service system comprises an inlet port configured to connect to an air conditioning system, a recovery valve fluidly connected to the inlet port, an ambient temperature sensor configured to generate an ambient temperature signal corresponding to an ambient temperature of the refrigerant service system, an accumulator fluidly connected to the recovery valve and including a pressure transducer configured to generate an electronic signal corresponding to a pressure in the accumulator, and a controller. The controller is operable to determine a target pressure for the accumulator based on the ambient temperature, to obtain a current pressure in the accumulator from the pressure transducer, and to operate the recovery valve based upon the accumulator target pressure to control flow of refrigerant from the air conditioning system to the accumulator as a function of the obtained current pressure and the determined target pressure for the accumulator.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
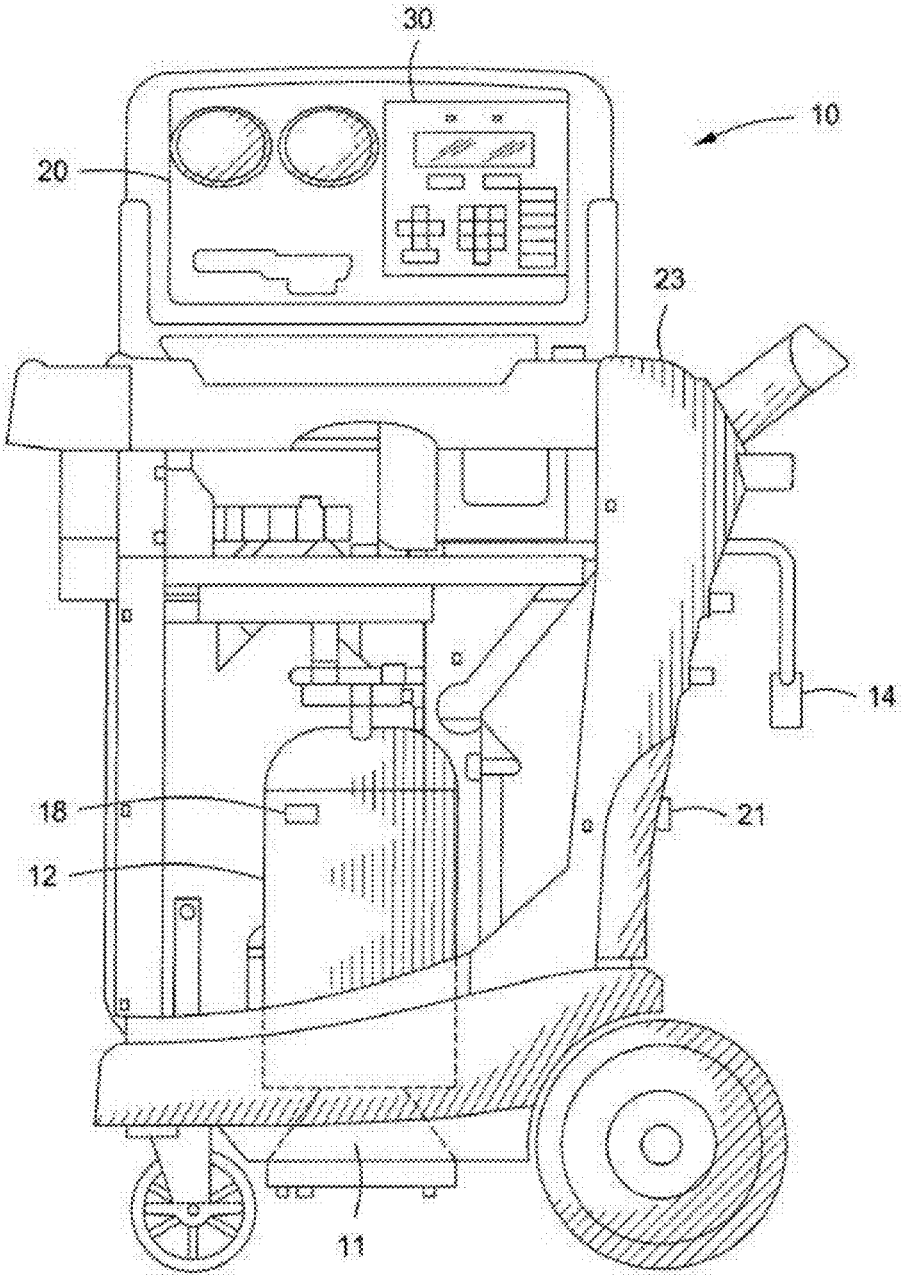
FIG. 1 is an illustration of an air conditioning service ("ACS") machine.

FIG. 1 is an illustration of an air conditioning service ("ACS") unit 10. The ACS unit 10 includes a refrigerant container or internal storage vessel ("ISV") 12, a controller 20, a housing 23, and an input/output unit 30. The housing includes an external temperature sensor 21 configured to sense an ambient temperature outside the ACS unit 10. Hose connections 14 (only one is shown in FIG. 1) protrude from the housing 23 to connect to an A/C system and facilitate transfer of refrigerant to and from the ACS unit 10.

The ISV 12 is configured to store refrigerant for the ACS unit 10. No limitations are placed on the kind of refrigerant that may be used in the ACS system. As such, the ISV 12 is configured to accommodate any refrigerant that is desired to be collected. In some embodiments, the ISV 12 is particularly configured to accommodate refrigerants that are commonly used in the A/C systems of vehicles (e.g., cars, trucks, boats, planes, etc.), for example R-134a, $CO_2$, or R1234yf. The ISV 12 includes an ISV scale 11 configured to sense the weight of the ISV tank 12. The ISV further includes an ISV temperature sensor 18 configured to sense a temperature of the ISV tank 12. In some embodiments, the temperature sensor 18 is placed on the outside of the ISV 12, while in other embodiments the sensor 18 is mounted inside the ISV 12. In some embodiments, the ACS unit has multiple ISV tanks configured to store different refrigerants. Each independent ISV in one embodiment includes a separate scale and temperature sensor. In other embodiments, the independent ISV tanks are all weighed by a single ISV scale.

Figure 2:
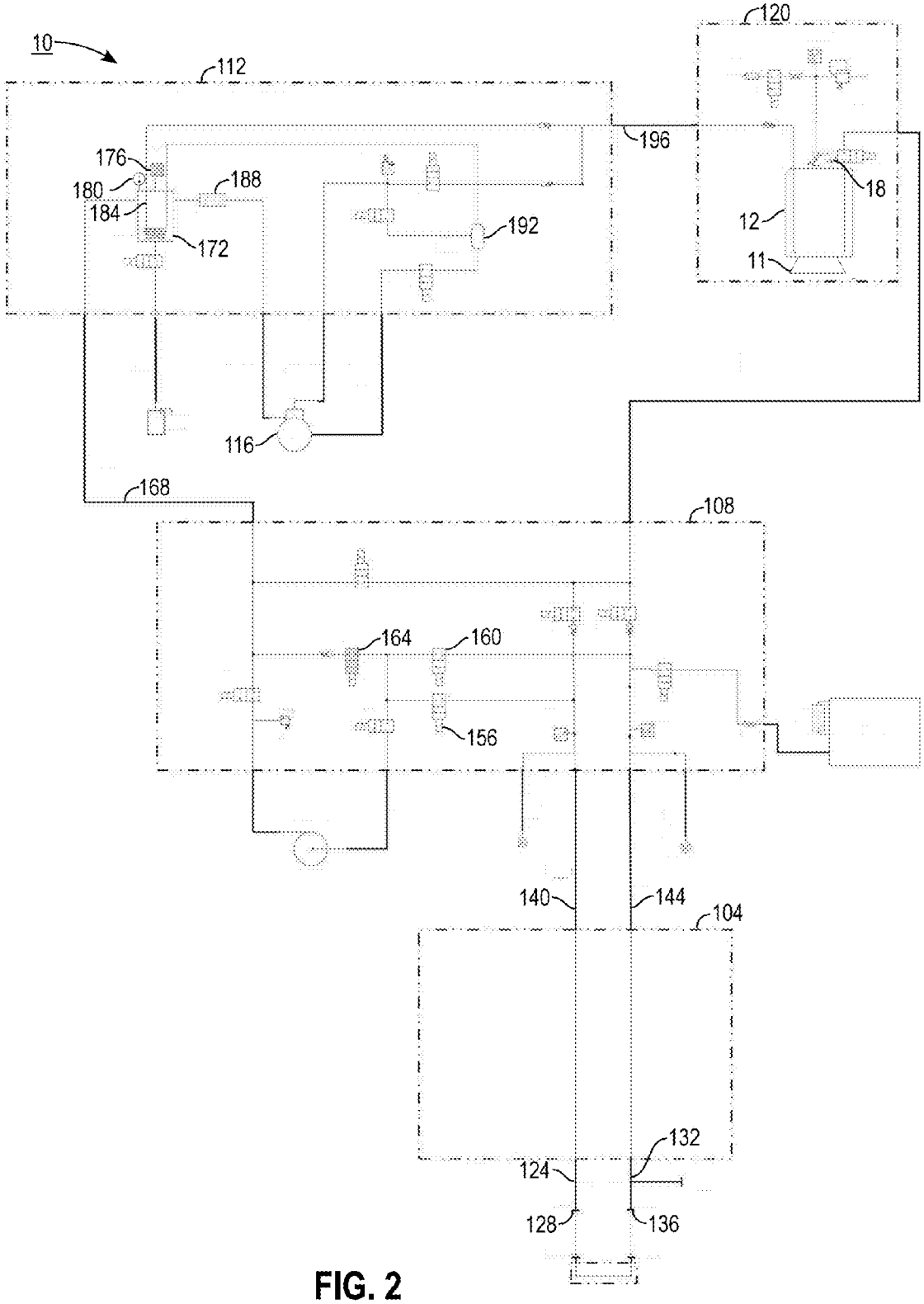
FIG. 2 is a schematic view of the ACS machine of FIG. 1.

Further details of the ACS system 10 are described with reference to FIG. 2, which is a schematic diagram of the ACS system 10 of FIG. 1. The ACS system 10 includes a bulkhead manifold 104, a top manifold 108, a lower manifold 112, a compressor 116, and an ISV assembly 120. The bulkhead manifold 104 has a high-side service hose 124 with a high-side coupler 128 and a low-side service hose 132 with a low-side coupler 136. The high-side and low-side service hoses 124, 132, respectively, are configured to attach to high-side and low-side service ports of an air conditioning system, and each of the service hoses 124, 132 are connected to a respective hose connection 14 (FIG. 1). The bulkhead manifold 104 routes the high-side service hose 124 to a high-side bulkhead hose 140 and the low-side service hose 132 to a low-side bulkhead hose 144. The high-side and low-side bulkhead hoses 140, 144 each connect the bulkhead manifold 104 to the top manifold 108.

The top manifold 108 includes a high-side inlet valve 156, which is connected to the high-side bulkhead hose 140, and a low-side inlet valve 160, which is connected to the low-side bulkhead hose 144. The inlet valves 156, 160 both connect to a recovery valve 164, which is connected to a manifold connection tube 168. The manifold connection tube 168 fluidly couples the top manifold 108 to the lower manifold 112.

The lower manifold 112 includes an accumulator 172 having an accumulator pressure transducer 176 configured to sense the pressure in the accumulator 172, an accumulator temperature sensor 180 configured to sense the temperature in the accumulator 172, and a heat exchanger 184. The lower manifold further includes a filter and dryer unit 188 and a compressor oil separator 192.

The ISV assembly 120 includes the ISV tank 12 having the ISV temperature sensor 18, and the ISV scale 11. The tank vapor hose 196 delivers the refrigerant vapor from the lower manifold 112 to the ISV assembly 120 for storage in the ISV tank 12.

Figure 3:
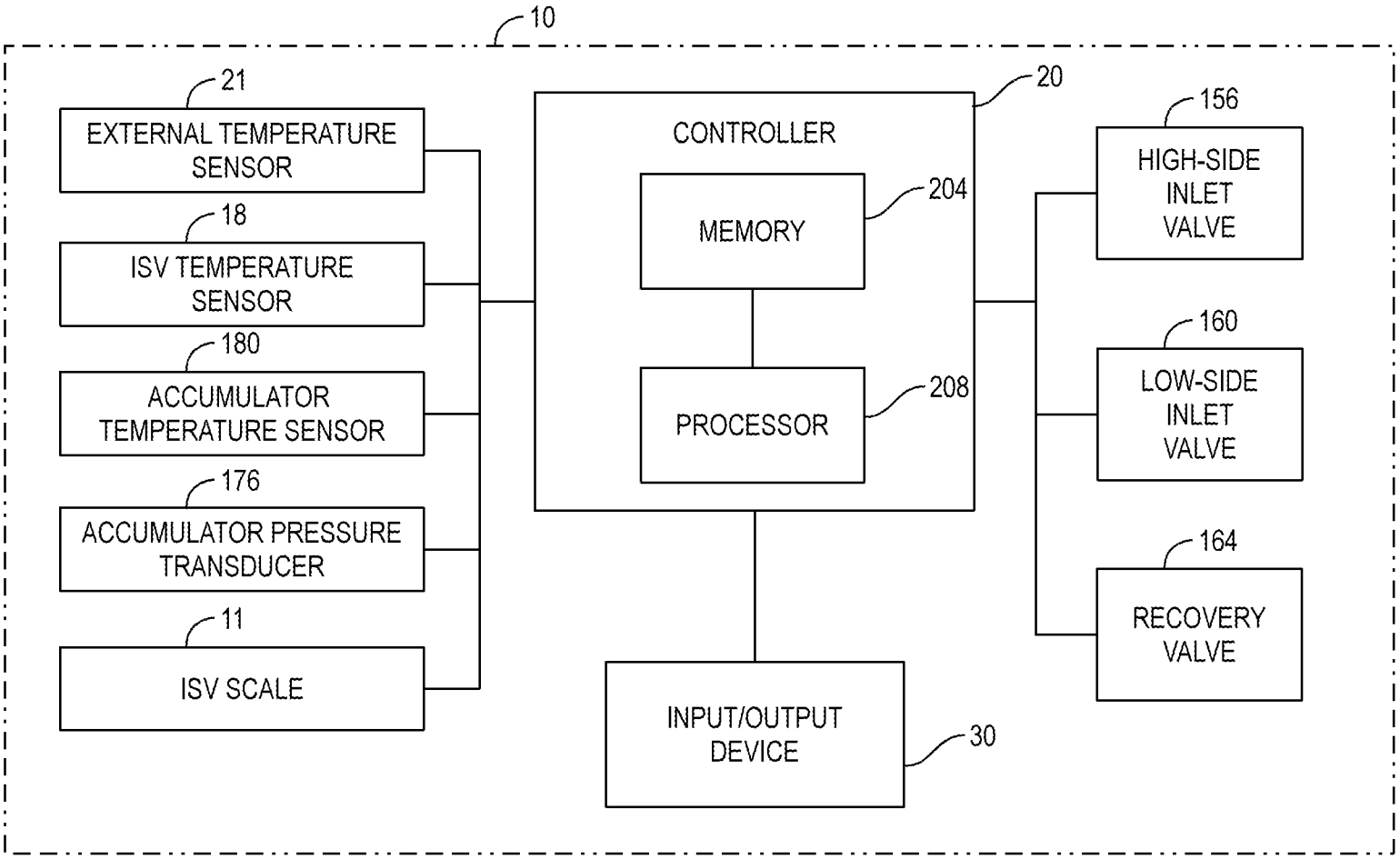
FIG. 3 is a schematic view of the control components of the ACS machine of FIG. 1.

FIG. 3 is a schematic diagram of the controller 20 and the components communicating with the controller 20 in the ACS system 10. Operation and control of the various components and functions of the ACS system 10 are performed with the aid of the controller 20. The controller 20 is implemented with a general or specialized programmable processor 208 that executes programmed instructions. In some embodiments, the controller includes more than one general or specialized programmable processor. The instructions and data required to perform the programmed functions are stored in a memory unit 204 associated with the controller 20. The processor 208, memory 204, and interface circuitry configure the controller 20 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The external temperature sensor 21, ISV temperature sensor 18, and accumulator temperature sensor 180 are configured to transmit electronic signals representing the respective sensed temperatures to the controller 20. The accumulator pressure transducer 176 transmits electronic signals representing the sensed pressure in the accumulator 172 to the controller 20 and the ISV scale 11 transmits electronic signals representing the sensed mass of the ISV 12 to the controller 20. In various different embodiments, the ACS unit 10 does not include all of the sensors 21, 18, 180, 176, and 11. In such embodiments, the ACS unit 10 can be configured with any desired combination of an external temperature sensor 21, an ISV temperature sensor 18, an accumulator temperature sensor 180, an accumulator pressure transducer 176, and an ISV scale.

The controller 20 is electrically connected to and configured to receive the temperature signals from the temperature sensors 18, 21, and 180, receive the pressure signal from the pressure transducer 176, and receive the ISV mass signal from the ISV scale 11. The signals from the sensors and transducers are transmitted when requested by the controller 20 or are sent continuously or on a predetermined basis, such as every 30 seconds, minute, 5 minutes, 15 minutes, 30 minutes, hour, etc.

The signals received by the controller 20 are stored in the memory 204 of the controller 20. The processor 208 transmits signals to operate the high-side inlet valve 156, the low-side inlet valve 160, and the recovery valve 164 based on the sensor signals and control algorithms stored in the memory 204 of the controller 20. The controller is also connected to the input/output device 30 to enable a user to input parameters and activate operating algorithms for the controller 20, and to enable the controller to display information to the user of the ACS unit 10.

Figure 4:
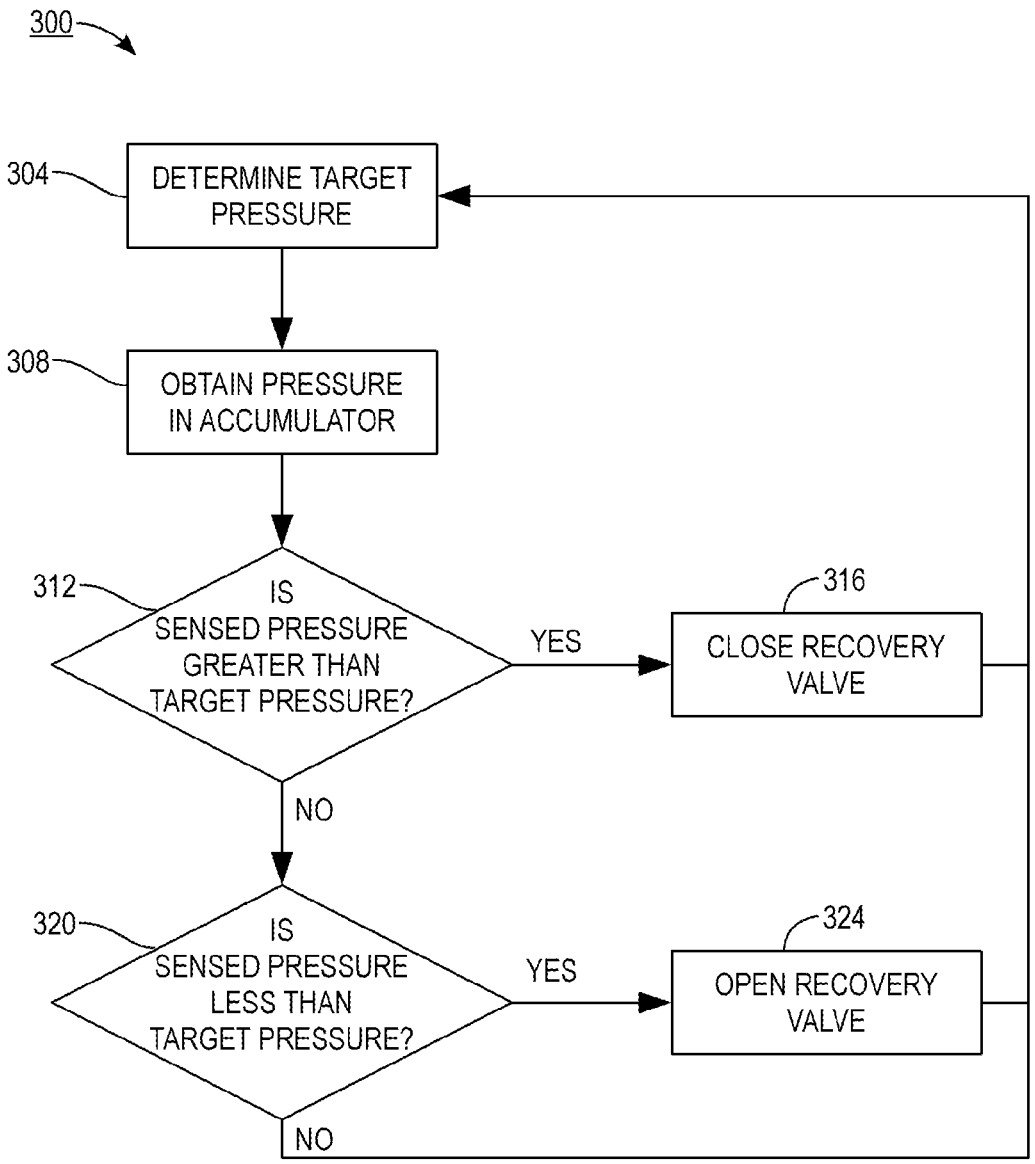
FIG. 4 is a process diagram of a method of operating an ACS machine during a recovery operation.

FIG. 4 illustrates a method 300 for operating an ACS system, such as the ACS unit 10 described above with reference to FIGS. 1-3, during a recovery operation. The processor 208 is configured to execute programmed instructions stored in the memory 204 to operate the components in the ACS unit 10 to implement the method 300. The method begins with the controller determining the target pressure (block 304). The target pressure is determined from a temperature reading in the accumulator, the ambient temperature, the rate of pressure change in the accumulator, the rate of change of mass in the ISV, and/or the rate of temperature change in the ISV. The target pressure is generally less than or equal to the saturated vapor pressure of the refrigerant at the temperature in the accumulator. Various methods of determining the target pressure are discussed in more detail below with reference to FIGS. 5-9.

Next, the controller obtains the pressure of the accumulator (block 308). The pressure in the accumulator can be determined by the pressure transducer in the accumulator sensing the pressure in the accumulator and transmitting a signal representing the accumulator pressure to the controller. In some embodiments, the controller recalls a pressure value stored in the memory. The controller receives the accumulator pressure signal and compares the accumulator pressure with the target pressure (block 312). If the sensed accumulator pressure is greater than the target pressure, then the recovery valve is closed to reduce the pressure in the accumulator to the target pressure (block 316) and the process repeats from block 304. Since the target pressure is less than or equal to the saturated vapor pressure of the refrigerant, the accumulator operates such that the refrigerant exiting the accumulator is predominantly or entirely in the vapor state. If the sensed accumulator pressure is less than the target pressure (block 320), then the controller operates the recovery valve to open (block 324), increasing the pressure in the accumulator to improve recovery efficiency. The process then continues from block 304. If the accumulator pressure is equal to the target pressure, then the process continues from block 304 without adjusting the operation of the recovery valve.

While the above method for controlling the pressure in the accumulator is described with reference to a simple control loop, the reader should appreciate that there are other ways in which the target pressure can be used to regulate the use of the recovery valve. For example, in a system having variable-position recovery valve, the relationship between the current accumulator pressure and the target pressure can be used to determine the degree of opening of the variable position valve. In some embodiments, proportional-integral-derivative (PID) control is used to more accurately retain the accumulator pressure at the target pressure. In some embodiments, a PID controller is used with a variable-position recovery valve to regulate the pressure in the accumulator.

As discussed above, there are numerous methods for determining the target pressure in the accumulator. FIGS. 5-9 each illustrate a different method of determining and/or adjusting the target pressure of the accumulator.

Figure 5:
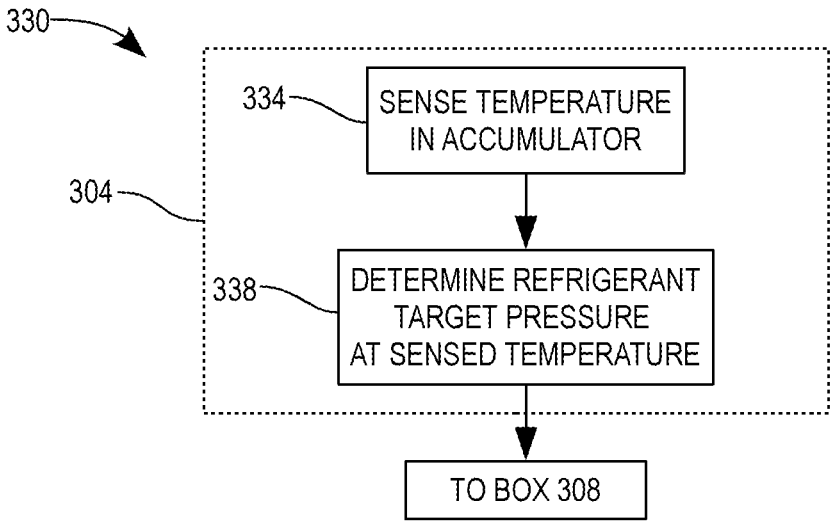
FIG. 5 is a process diagram of a method of determining the target pressure at which to operate the accumulator of an ACS machine during a recovery operation.

FIG. 5 illustrates a process 330 of determining target pressure in the accumulator using the temperature in the accumulator. The processor 208 is configured to execute programmed instructions stored in the memory 204 to operate the components in the ACS unit 10 to implement the method 330. The method 330 begins with the accumulator temperature sensor sensing the temperature in the accumulator (block 334). The sensor transmits a signal representing the sensed temperature to the controller. In some embodiments, the temperature in the accumulator is stored in the memory, and the controller is configured to recall the stored temperature from the memory instead of receiving the signal directly from the sensor. Once the controller receives the accumulator temperature signal the target pressure is determined for the sensed temperature (block 338). In one embodiment, the target pressure is the saturated vapor pressure of the refrigerant used in the system at the accumulator temperature. In another embodiment, the target pressure is less than the saturated vapor pressure by a predetermined amount to ensure that the accumulator operates below the saturated vapor pressure of the refrigerant. After the target pressure is determined, the process continues at box 308 to operate the recovery valve as discussed above.

Figure 6:
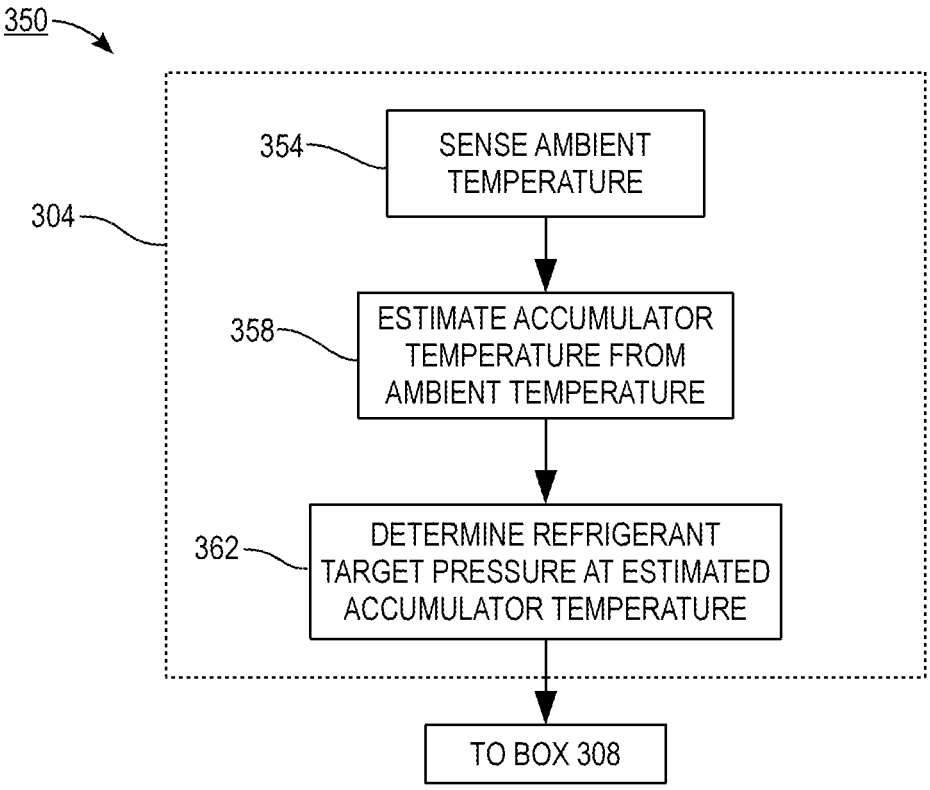
FIG. 6 is a process diagram of another method of determining the target pressure at which to operate the accumulator of an ACS machine during a recovery operation.

FIG. 6 illustrates another method 350 for determining the target accumulator pressure in an ACS system, which can be performed by the processor 208 executing programmed instructions stored in memory 204, by using the ambient temperature outside the ACS unit. The method 350 begins with the external sensor sensing the ambient temperature outside the ACS system (block 354) and transmitting a signal representing the ambient temperature to the controller. In some embodiments, the ambient temperature is stored in the memory, and the controller is configured to recall the stored temperature from the memory instead of receiving the signal directly from the sensor. The controller receives the ambient temperature signal and estimates the accumulator temperature based on the ambient temperature (block 358). In some embodiments, the accumulator temperature is estimated by adding or subtracting an empirically determined constant to the sensed exterior temperature. In other embodiments, the accumulator temperature is assumed to be equal to the exterior temperature of the ACS unit. The controller then determines the target pressure at the estimated accumulator temperature (block 362). In one embodiment, the target pressure is the saturated vapor pressure of the refrigerant used in the system at the estimated temperature. In another embodiment, the target pressure is the saturated vapor pressure less a predetermined value to provide a factor of safety to the system to account for a difference between the accumulator temperature and the ambient temperature, sensing errors, sensor lag, and other errors in the system. After the target pressure is determined, the process continues at box 308 to operate the recovery valve as discussed above. The above method 350 of determining the target pressure for the accumulator is particularly in ACS units that do not have a temperature sensor in the accumulator.

Figure 7:
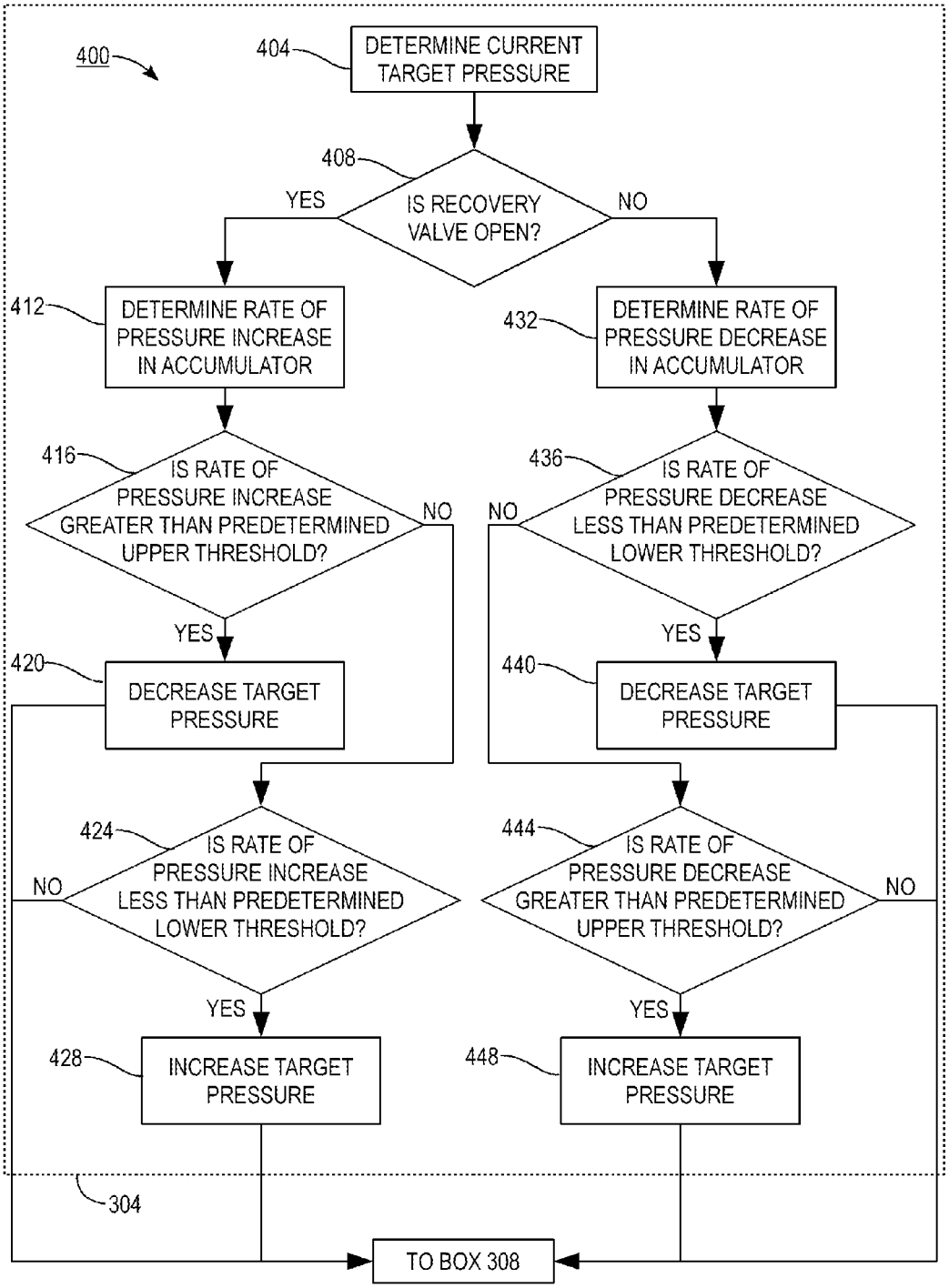
FIG. 7 is a process diagram of another method of determining the target pressure at which to operate the accumulator of an ACS machine during a recovery operation.

FIG. 7 illustrates another method 400 for determining the target pressure in the accumulator of an ACS system, such as the ACS unit 10 described above with reference to FIGS. 1-3, during a recovery operation. The processor 208 is configured to execute programmed instructions stored in the memory 204 to operate the components in the ACS unit 10 to implement the method 400. The method 400 begins with the controller determining the current target pressure (block 404). In some embodiments, when the ACS unit is beginning to operate, the target pressure is set as a baseline value recalled from the memory of the processor. In other embodiments, the initial target pressure is determined using one of the other methods described herein. The target pressure can also be recalled from memory as the previous target pressure value determined using the method 400 once the system is operating.

The method then continues by determining whether the recovery valve is open (block 408). If the recovery valve is open, the pressure transducer senses the pressure in the accumulator, and transmits a signal representing the accumulator pressure to the controller. In some embodiments, the accumulator pressure is stored in the memory, and the controller is configured to recall the stored accumulator pressure reading from the memory instead of receiving the signal directly from the sensor. The controller then uses the accumulator pressure signal and one or more previous pressure values recalled from the memory to determine the rate of the pressure increase in the accumulator due to the pressurized refrigerant passing through the recovery valve (block 412).

Next, the rate of pressure increase is compared with an upper threshold (block 416). If there is liquid refrigerant in the accumulator, then the pressure rise in the accumulator will be greater than if there is only vapor refrigerant in the accumulator. As such, if the rate of the pressure increase in the accumulator when the valve is open is greater than a predetermined upper threshold, the target pressure in the accumulator is decreased (block 420) and the process advances to operation of the recovery valve using the adjusted target pressure at block 308. In some embodiments, the predetermined upper threshold is the pressure increase rate at which there is known to be liquid in the accumulator, while in other embodiments the upper threshold is selected as a value that is less than the rate at which there is known to be liquid in the accumulator in order to provide a safety factor to account for possible measurement errors.

If the rate of pressure increase is less than the predetermined upper threshold, then the process continues by comparing the rate of pressure increase with a lower threshold (block 424). The lower threshold is below the known value at which the refrigerant is entirely in the vapor state, and is based on the rate of pressure increase resulting from a desired minimum efficiency for the recovery operation. If the rate of pressure increase when the recovery valve is open is below the lower threshold, then the target pressure in the accumulator is increased to improve recovery efficiency (block 428) and the process advances to operation of the recovery valve using the adjusted target pressure at block 308. If the rate of pressure increase is lower than the upper threshold but greater than the lower threshold, then the target pressure is not adjusted and the process continues at block 308. In some embodiments, the upper and lower thresholds are equal, for example when a specific rate of pressure increase is desired during operation of the accumulator rather than a pressure increase rate within a range of values.

If the recovery valve is not open (block 404), then the pressure transducer in the accumulator senses the pressure in the accumulator and transmits a signal representing the accumulator pressure to the controller. In some embodiments, the ambient temperature is stored in the memory, and the controller is configured to recall the stored temperature from the memory instead of receiving the signal directly from the sensor. Since the recovery valve is closed, the pressure in the accumulator decreases as the refrigerant leaves the accumulator while no additional refrigerant flows into the accumulator. The controller uses the accumulator pressure signal and one or more previous pressure values recalled from the memory to determine the rate of the pressure decrease in the accumulator due to the refrigerant exiting the accumulator (block 432).

Next, the rate of pressure decrease is compared with a lower threshold (block 436). If there is liquid refrigerant in the accumulator, then the pressure decrease in the accumulator when the recovery valve is closed will be slower than if there is only vapor refrigerant in the accumulator. As such, if the rate of pressure decrease when the valve is closed is less than a predetermined lower threshold, the target pressure in the accumulator is decreased (block 440) and the process advances to operation of the recovery valve at block 308. In some embodiments, the predetermined lower threshold is the pressure decrease rate at which there is known to be liquid in the accumulator, while in other embodiments the lower threshold is selected as a value that is greater than the rate at which there is known to be liquid in the accumulator in order to account for possible measurement errors.

If the rate of pressure decrease is greater than the predetermined lower threshold, then the process continues by comparing the rate of pressure decrease with an upper threshold (block 444). The upper threshold is greater than a value at which it is known that the refrigerant is entirely in the vapor state, and is based on a rate of pressure decrease resulting from a desired minimum efficiency for the recovery operation. If the rate of pressure decrease when the recovery valve is closed is above the upper threshold, then the target pressure in the accumulator is increased to improve recovery efficiency (block 448) and the process continues at block 308 using the adjusted target pressure. If the rate of pressure decrease is less than the predetermined upper threshold but greater than the lower threshold, then the target pressure is not adjusted and the process continues at block 308. In some embodiments, the lower and upper thresholds are equal, for example when a specific rate of pressure decrease is desired during operation of the accumulator rather than a pressure decrease rate within a range of values. The reader should appreciate that in various embodiments, some steps of the above method 400 are omitted or are performed in a different sequence than illustrated in FIG. 7.

Figure 8:
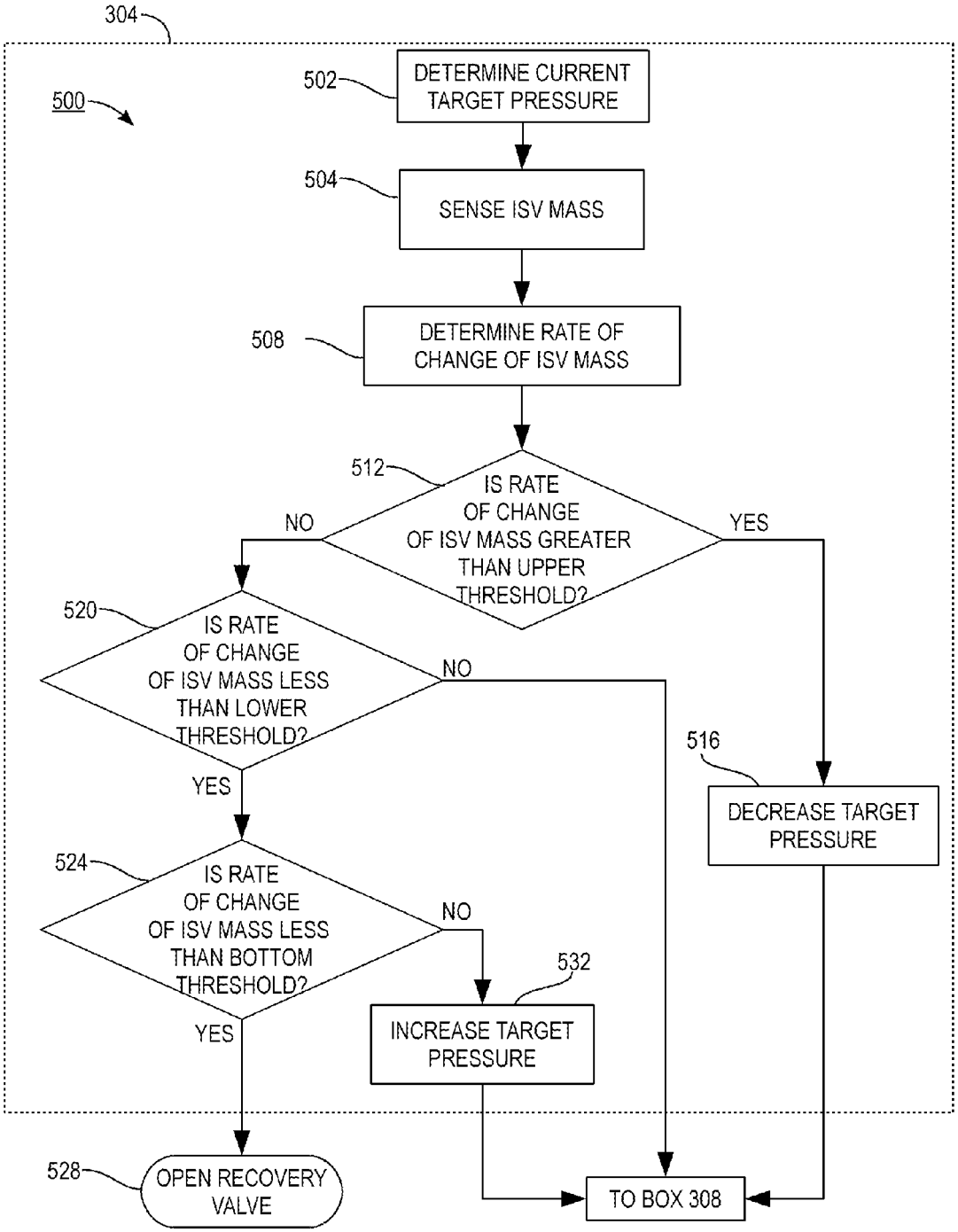
FIG. 8 is a process diagram of another method of determining the target pressure at which to operate the accumulator of an ACS machine during a recovery operation.

FIG. 8 illustrates yet another method 500 for determining target pressure in the accumulator of an ACS system, such as the ACS unit 10 described above with reference to FIGS. 1-3, during a recovery operation. The processor 208 is configured to execute programmed instructions stored in the memory 204 to operate the components in the ACS unit 10 to implement the method 500. The method 500 begins with the controller determining the current target pressure (block 502). In some embodiments, when the ACS unit is beginning to operate, the target pressure is set as a baseline value recalled from the memory of the processor. In other embodiments, the initial target pressure is determined using one of the other methods described herein. The target pressure can also be recalled from memory as the previous target pressure value determined using the method 500 once a target pressure has been established.

The ISV scale senses the mass in the ISV tank (block 504) and transmits a signal representing the sensed mass to the controller. In some embodiments, the ISV mass signals are recalled from the processor memory rather than being transmitted directly from the sensor. The controller receives the ISV mass signal and determines the rate of change of the ISV mass using the sensed ISV mass and a previously stored ISV mass reading recalled from memory (block 508). The rate of change of the mass in the ISV is then compared with an upper threshold (block 512). The manifold of the recovery system is assumed to be at steady state, and as a result the mass of refrigerant leaving the manifold to be stored in the ISV must be equal to the mass entering the accumulator. The rate of mass flowing into the accumulator is proportional to the pressure in the accumulator and, therefore, the increase in mass of the ISV is proportional to the pressure in the accumulator. If the increase in mass in the ISV is too high, then an excess of refrigerant is flowing into the accumulator, increasing the pressure in the accumulator, which can result in some refrigerant in the accumulator being in the liquid phase. Consequently, the rate of increase in ISV mass will be greater if there is liquid refrigerant present in the accumulator compared to only refrigerant in the vapor phase being present in the accumulator. The upper threshold, therefore, is selected based on a value at which it is known that liquid refrigerant is entering the accumulator at a critical rate indicative that liquid phase refrigerant is about to enter the compressor. In some embodiments, the upper threshold is at the critical rate, while in other embodiments the upper threshold is below the critical rate to account for measurement errors and ensure a factor of safety in the system. If the rate of ISV mass change is greater than the upper threshold, then the target pressure is decreased (block 516) and the recovery valve is operated with the adjusted target pressure at block 308.

If the rate of change of mass of the ISV is less than the upper threshold, then the controller compares the rate of change of the mass of the ISV with a lower threshold (block 520). The lower threshold is based on a rate of ISV mass increase at a minimum desired efficiency for the recovery operation. If the rate of change of the ISV mass is between the upper and lower thresholds, then the target pressure is not adjusted and the process continues at block 308. If the rate of ISV mass increase is below the lower threshold, then the controller compares the rate of ISV mass increase to a bottom threshold (block 524), below which it is known that the pressure in the vehicle from which the refrigerant is being recovered has dropped below a level where only vapor phase refrigerant is being recovered. If the rate of the ISV mass increase is below the bottom threshold, the pressure of the refrigerant flowing into the accumulator is too low to cause condensation of the refrigerant in the accumulator, and the recovery valve is opened (block 528) for the remainder of the refrigerant recovery operation. If the rate of ISV mass increase is greater than the bottom threshold, but less than the lower threshold, then the target pressure is increased to improve recovery efficiency (block 532) and the method proceeds with operating the recovery valve with the adjusted target pressure at block 308.

In some embodiments, the upper and lower thresholds are equal, for example when a specific rate of mass change of the ISV is desired during operation of the accumulator rather than an ISV mass change rate within a range of values. In further embodiments, the process omits blocks 524 and 528, and proceeds with increasing the target pressure (block 532) if the rate of mass change of the ISV is less than the lower threshold. The reader should appreciate that in various embodiments, certain steps of the above method 500 are omitted or are performed in a different sequence than illustrated in FIG. 8

Figure 9:
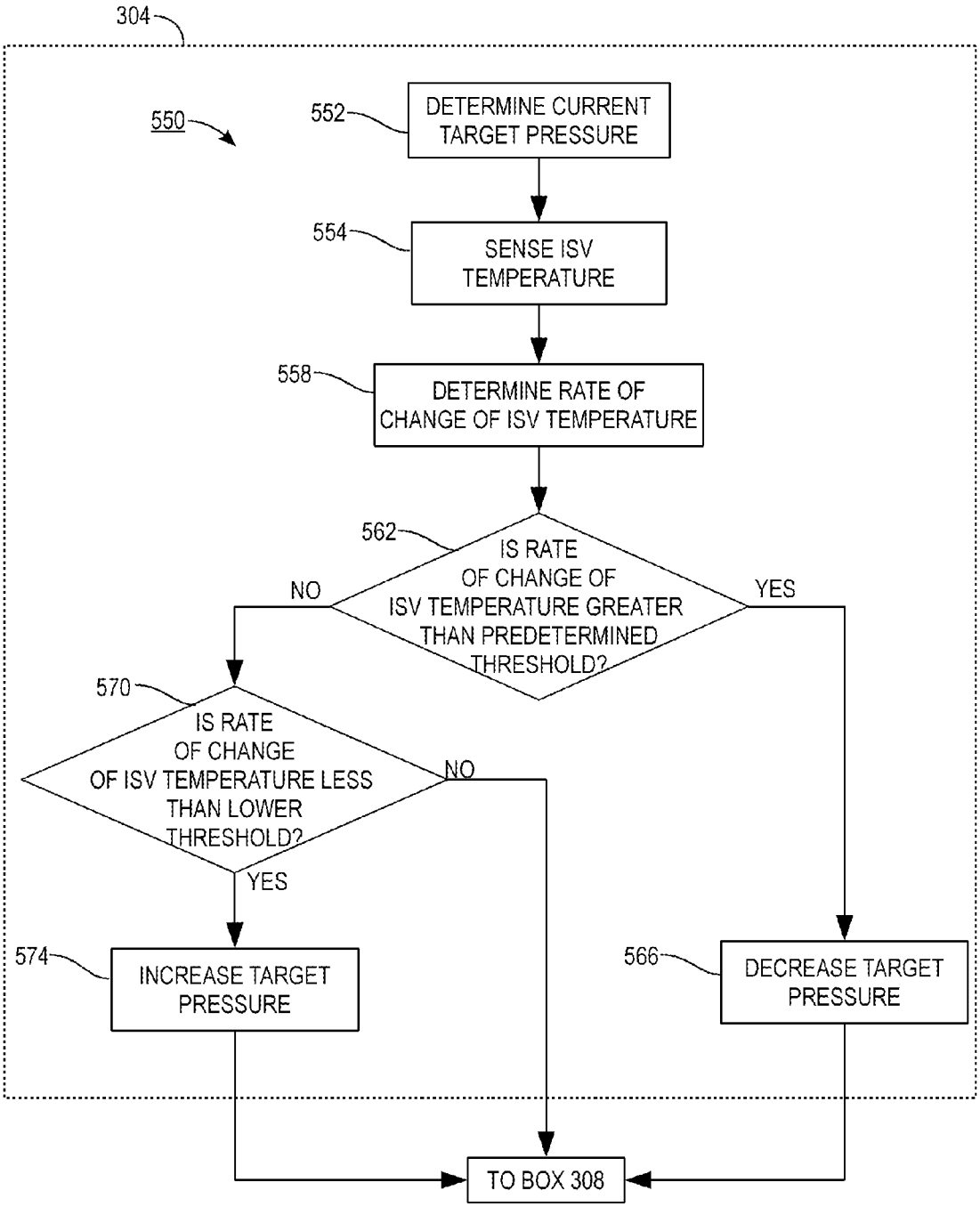
FIG. 9 is a process diagram of yet another method of determining the target pressure at which to operate the accumulator of an ACS machine during a recovery operation.

FIG. 9 illustrates yet another method 550 for operating an ACS system, such as the ACS unit 10 described above with reference to FIGS. 1-3, during a recovery operation. The processor 208 is configured to execute programmed instructions stored in the memory 204 to operate the components in the ACS unit 10 to implement the method 550. The method 550 begins with the controller determining the current target pressure (block 552). In some embodiments, when the ACS unit is beginning to operate, the target pressure is set as a baseline value recalled from the memory of the processor. In other embodiments, the initial target pressure is determined using one of the other methods described herein. The target pressure can also be recalled from memory as the previous target pressure value determined using the method 550 once a target pressure has been established.

Next, the ISV temperature sensor senses the temperature of the ISV tank (block 554) and transmitting a signal representing the ISV tank temperature to the controller. In some embodiments, the ISV temperature signals are recalled from the processor memory rather than being directly transmitted from the sensor. The controller receives the ISV temperature signal and determines the rate of change of the ISV temperature using the sensed ISV temperature and a previously stored ISV temperature reading recalled from memory (block 558). The controller receives the ISV temperature and determines the rate of change of the ISV temperature using the sensed ISV temperature and a previously sensed temperature value stored in memory (block 558). The rate of change of the temperature in the ISV is then compared with an upper threshold (block 562). When the refrigerant is compressed in the compressor, the temperature of the refrigerant increases and the refrigerant flows through the heat exchanger to the ISV tank. If there is liquid refrigerant entering the accumulator, the heat exchanger located therein will not be able to remove the heat from the refrigerant passing to the ISV as quickly as when only vapor is entering the accumulator, and the refrigerant flowing from the heat exchanger to the ISV will therefore have a higher temperature. As a result, the rate of increase in ISV temperature will be greater if there is liquid refrigerant entering the accumulator compared to only vapor phase refrigerant entering the accumulator. The upper threshold is therefore selected based on a value at which it is known that liquid-state refrigerant is entering the accumulator. In some embodiments, the upper threshold is the temperature increase rate in the ISV at which it is known that liquid-state refrigerant is entering the accumulator, while in other embodiments, the upper threshold is below the temperature increase rate in the ISV at which it is known that liquid-state refrigerant is entering the accumulator to provide a factor of safety. If the rate of ISV temperature change is greater than the upper threshold, then the target pressure is decreased (block 566) and the process continues at block 308 with operating the recovery valve. In some embodiments, the upper threshold of the ISV temperature change rate is a value selected to control the temperature in the ISV, while still optimizing recovery efficiency. Excess heat in the ISV results in increased pressure in the ISV and eventually activation of a pressure relief valve (not shown) in the ISV, resulting in loss of refrigerant to the atmosphere. Thus, reducing the rate at which the ISV temperature increases by controlling the flow of refrigerant into the accumulator reduces the chance of the temperature in the ISV causing the pressure relief valve to open and waste refrigerant.

If the rate of change of the ISV temperature is not greater than the upper threshold, then the controller compares the rate of change of the ISV temperature with a lower threshold (block 570). The lower threshold is based on a rate of change in the ISV temperature resulting from a minimum desired efficiency of the recovery operation. If the rate of change of ISV temperature change is below the lower threshold, then the controller increases the target pressure to improve recovery efficiency (block 574) and proceeds to operating the recovery valve with the adjusted target pressure at block 308. If the rate of change of the ISV temperature is between the upper and lower thresholds, then the target pressure is not adjusted and the process continues at block 308. In some embodiments, the upper and lower thresholds are equal, for example when a specific rate of temperature change of the ISV is desired during operation of the accumulator rather than an ISV temperature change rate within a range of values. The reader should appreciate that in various embodiments, some steps of the above method 550 are omitted or are performed in a different sequence than illustrated in FIG. 9.

While each method is described above individually, the reader should appreciate that in various embodiments, the target pressure is determined using a combination of any or all of the above methods 330, 350, 400, 500, and 550.

Figure 10:
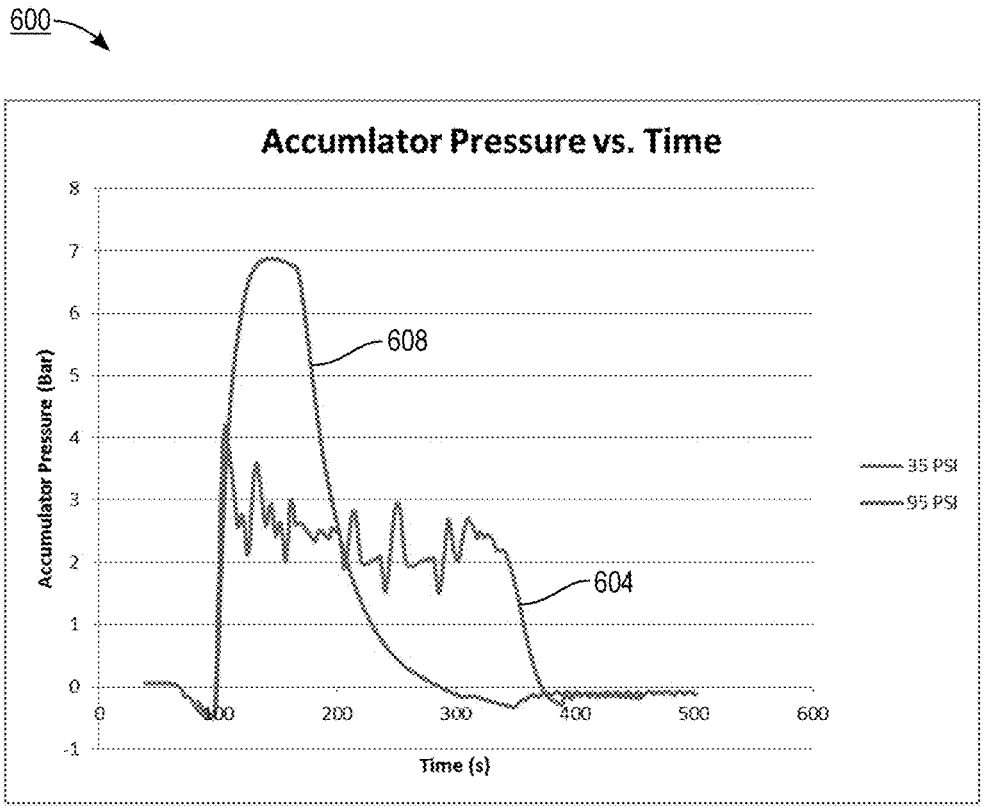
FIG. 10 is a graph showing the accumulator pressure versus time for a recovery processes performed at a target pressure of 35 psi and a recovery process performed at a target pressure of 95 psi.

FIG. 10 illustrates a graph 600 of the accumulator pressure against time for a target pressure of 35 psi (line 604) and a target pressure of 95 psi (line 608), which corresponds to the saturation vapor pressure of R-134a at approximately 76 degrees F. As can be seen from the graph, increasing the target pressure from 35 psi to 95 psi reduces the recovery time from approximately 370 seconds down to approximately 280 seconds.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. A refrigerant service system comprising:

an inlet port configured to connect to an air conditioning system;

a recovery valve fluidly connected to the inlet port;

an accumulator fluidly connected to the recovery valve and including a pressure transducer configured to generate an electronic signal corresponding to a pressure in the accumulator; and a controller configured to determine a target pressure for the accumulator based on at least one sensed condition of refrigerant, to obtain a current pressure in the accumulator from the pressure transducer, and to operate the recovery valve based upon the accumulator target pressure to control flow of refrigerant from the air conditioning system to the accumulator as a function of the obtained current pressure and the determined target pressure for the accumulator.

2. The refrigerant service system of claim 1, wherein the controller is further configured to operate the recovery valve to open in response to the obtained current pressure in the accumulator being less than the determined accumulator target pressure, and to operate the recovery valve to close in response to the obtained current pressure being greater than the determined accumulator target pressure.

3. The refrigerant service system of claim 1, further comprising:

a temperature sensor located in the accumulator and configured to generate a temperature signal corresponding to a temperature of the refrigerant in the accumulator, wherein the controller is further configured to obtain the temperature signal from the temperature sensor and to determine the target pressure in the accumulator based upon the temperature of the refrigerant in the accumulator.

4. The refrigerant service system of claim 1, wherein the controller is further configured to obtain at least two pressure readings from the pressure transducer in the accumulator, determine a rate of change of the accumulator pressure based upon the at least two pressure readings, and determine the target pressure in the accumulator based upon the determined rate of change of the accumulator pressure.

5. The refrigerant service system of 1, further comprising:

a refrigerant storage vessel fluidly connected downstream of the accumulator.

6. The refrigerant service system of claim 5, further comprising:

a scale configured to generate a mass signal corresponding to a sensed mass of the refrigerant storage vessel, wherein the controller is further configured to obtain at least two sensed mass readings from the scale, determine a mass flow rate of refrigerant flowing into the refrigerant storage vessel as a function of the at least two sensed mass readings, and determine the target pressure in the accumulator based upon the determined mass flow rate of refrigerant flowing into the refrigerant storage vessel.

7. The refrigerant service system of claim 5, further comprising:

a temperature sensor located at the refrigerant storage vessel and configured to generate a temperature corresponding to a sensed temperature of the refrigerant in the refrigerant storage vessel, wherein the controller is further configured to obtain at least two temperature readings from the temperature sensor, determine a rate of temperature change of the refrigerant in the refrigerant storage vessel based upon the at least two temperature readings, and determine the target pressure in the accumulator based upon the determined rate of temperature change of the refrigerant in the refrigerant storage vessel.

8. A method of recovering refrigerant from an air conditioning system, comprising:

determining an accumulator target pressure for an accumulator based upon a condition of refrigerant;

obtaining a current pressure in the accumulator from a pressure transducer configured to sense a pressure in the accumulator;

operating a recovery valve positioned in a fluid line between the accumulator and the air conditioning system and configured to control flow of refrigerant from the air conditioning system to the accumulator based upon the obtained current pressure signal and the determined target pressure for the accumulator.

9. The method of claim 8, the operating of the recovery valve further comprising:

opening the recovery valve in response to the obtained current pressure in the accumulator being less than the determined accumulator target pressure; and closing the recovery valve in response to the obtained current pressure being greater than the determined accumulator target pressure.

10. The method of claim 8, further comprising:

obtaining a temperature of refrigerant in the accumulator from a temperature sensor of the accumulator; and determining the target pressure in the accumulator based upon the obtained temperature of the refrigerant in the accumulator.

11. The method of claim 8, further comprising:

obtaining at least two pressure readings from the pressure transducer in the accumulator;

determining a rate of change of the accumulator pressure based upon the at least two pressure readings; and determining the target pressure in the accumulator based upon the determined rate of change of the accumulator pressure.

12. The method of claim 8, further comprising:

obtaining at least two sensed mass readings of a refrigerant storage vessel fluidly connected downstream of the accumulator from a scale configured to sense a mass of the refrigerant storage vessel;

determining a mass flow rate of refrigerant flowing into the refrigerant storage vessel as a function of the at least two sensed mass readings; and determining the target pressure in the accumulator based upon the determined mass flow rate of refrigerant flowing into the refrigerant storage vessel.

13. The method of claim 8, further comprising:

obtaining at least two temperature readings corresponding to a temperature of refrigerant in a refrigerant storage vessel fluidly connected downstream of the accumulator from a temperature sensor located at the refrigerant storage vessel;

determining a rate of temperature change of the refrigerant in the refrigerant storage vessel based upon the at least two temperature readings; and determining the target pressure in the accumulator based upon the determined rate of temperature change of the refrigerant in the refrigerant storage vessel.

14. A refrigerant service system comprising:

an inlet port configured to connect to an air conditioning system;

a recovery valve fluidly connected to the inlet port;

an ambient temperature sensor configured to generate an ambient temperature signal corresponding to an ambient temperature of the refrigerant service system;

an accumulator fluidly connected to the recovery valve and including a pressure transducer configured to generate an electronic signal corresponding to a pressure in the accumulator; and a controller configured to determine a target pressure for the accumulator based on the ambient temperature, to obtain a current pressure in the accumulator from the pressure transducer, and to operate the recovery valve based upon the accumulator target pressure to control flow of refrigerant from the air conditioning system to the accumulator as a function of the obtained current pressure and the determined target pressure for the accumulator.

* * * * *